US006056787A

United States Patent [19]

Renner et al.

[11] Patent Number: 6,056,787

[45] **Date of Patent: *May 2, 2000**

[54] PROCESS FOR THE PRETREATMENT OF FIBERS

[75] Inventors: Gerd Friedrich Renner, Kürten; Michael Pirkotsch; Klaus Walz, both of Leverkusen; Torsten Groth, Odenthal; Winfried Joentgen, Köln, all of Germany

[73] Assignee: Bayer Aktiengesellschaft, Leverkusen, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/933,769

[22] Filed: Sep. 19, 1997

[30] Foreign Application Priority Data

Sep. 20, 1996 [DE] Germany ..... 196 38 569

[51] Int. Cl.[7] ..... D06L 3/00; D06L 3/02

[52] U.S. Cl. ..... 8/111; 8/101; 8/107; 510/531; 510/533; 510/309; 510/316; 510/317; 510/318; 252/8.81; 252/8.84; 252/8.85; 252/8.86

[58] Field of Search ..... 8/111, 101, 107; 252/8.81, 8.84, 8.85, 8.86; 510/531, 533, 309, 316, 317, 318; 562/553, 568, 567, 571, 590

[56] References Cited

U.S. PATENT DOCUMENTS

| | | | |
|---|---|---|---|
| 3,755,028 | 8/1973 | Wood | 156/62.2 |
| 4,619,663 | 10/1986 | Tatin | 8/107 |
| 5,362,412 | 11/1994 | Hartman et al. | 510/318 |
| 5,670,082 | 9/1997 | Stehlin et al. | 252/186.42 |

FOREIGN PATENT DOCUMENTS

| | | |
|---|---|---|
| 3739610 | 6/1989 | Germany . |
| 4340043 | 6/1995 | Germany . |
| 4340043A1 | 6/1995 | Germany . |
| 6329607 | 11/1994 | Japan . |
| 6330020 | 11/1994 | Japan . |
| 639863 | 12/1978 | U.S.S.R. . |
| 1306331 | 2/1973 | United Kingdom . |

OTHER PUBLICATIONS

English–language translation of DE 43 40 043 (Jun. 1, 1995).
Derwent Abstract of DE 337 39 610 A, Jun. 1, 1989.
Derwent Abstract of JP 09 310 097. Dec. 2, 1997.
Chemical Abstract 112:22790r, Jun. 1989.
Chemical Abstract 122: 160100y, Nov. 1994.
Chemical Abstract 90:121025d, Jun. 1977.

*Primary Examiner*—Alan Diamond
*Attorney, Agent, or Firm*—Norris, McLaughlin & Marcus

[57] ABSTRACT

Iminodisuccinic acids of the formula (I)

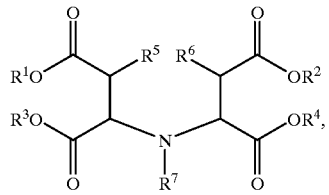

the substituents of which have the meaning given in the description, are bleaching regulators in $H_2O_2$ bleaching of textile-forming natural plant fibers or silk, wool and their mixtures with synthetics.

14 Claims, No Drawings

PROCESS FOR THE PRETREATMENT OF FIBERS

BACKGROUND OF THE INVENTION

The invention relates to compositions for the pretreatment of fibers comprising iminodisuccinic acids, their salts and their mixtures with one another, which can have an additional content of citric acid, gluconic acid and/or magnesium in ionic form, for a pretreating bleaching with $H_2O_2$. Such compositions are employed in aqueous solution.

Textile-forming natural plant fibers, such as cotton, sisal, jute and the like, and animal fibers, such as silk and wool, comprise, in the crude form, waxes, fats and other plant constituents which cause a yellowish-brown coloring of the fiber. As a result, not all the desired colorations are possible, furthermore, the colorations are not level. A pretreatment in which bleaching and washing are combined is therefore carried out on these fibers to remove the undesirable non-fibrous constituents and to destroy the substances which cause the yellowish-brown coloration. Such a pretreatment can be used on the fibers of the origin mentioned, on yarns produced therefrom and on woven fabric, knitted fabric or nonwovens of such fibers. This pretreatment can furthermore be applied to mixtures of such fibers with synthetic fibers and products produced therefrom.

So-called bleaching liquors which comprise water, hydrogen peroxide, wetting/washing and emulsifying agents, alkali for pH adjustment and $H_2O_2$ regulators (bleaching regulators, stabilizers) are employed for carrying out the combined pretreatment mentioned. Water-glass and inorganic phosphates, for example, have been employed as regulators for a long time. When water-glass (Na silicate) is used as a bleaching stabilizer, in particular in combination with Ca salts, insoluble Ca silicate deposits occur on the machine and material. The inorganic phosphates were later replaced by (poly)phosphonate because of over-fertilization of the waste waters. However, these phosphonates, which are regarded as irreplaceable, are difficult to degrade biologically, if at all, and therefore again pollute the waste waters in a different manner. Ethylenediamine-tetraacetic acid (EDTA), which also cannot be degraded biologically and furthermore is not absorbed by sewage sludge, pollutes water and raises objections in its use as an $H_2O_2$ regulator. Remobilization of heavy metals by EDTA, moreover, is not completely ruled out.

There was therefore the need to provide completely phosphorus-free and EDTA-free compositions as bleaching regulators (stabilizers), which also cause no deposits brought about, for example, by silicates. Development to date, however, has shown that it did not seem possible to dispense with phosphates or phosphonates or EDTA in such regulators.

SUMMARY OF THE INVENTION

Compositions for the pretreatment of textile-forming natural plant or animal fibers or their mixtures with synthetic fibers or of yarns, woven fabrics, knitted fabrics or nonwovens of such fibers or their mixtures by bleaching comprising iminodisuccinic acids, their salts and their mixtures with one another, of the formula (I)

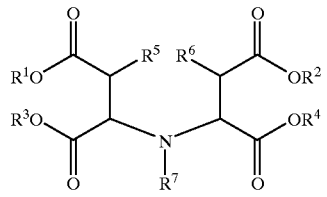

in which $R^1$, $R^2$, $R^3$ and $R^4$ independently of one another denote H, Li, Na, K, $NH_4$, $H_3NCH_2CH_2OH$, $H_2N(CH_2CH_2OH)_2$ or $HN(CH_2CH_2OH)_3$, $R^5$ and $R^6$ independently of one another represent H or OH and $R^7$ represents H, $CH_2CH_2OH$, $CH_2CH_2CH_2OH$, $CH_2CH(OH)CH_3$, $CH_2COOR^8$ or $CH_2CH_2COOR^8$, wherein $R^8$ independently of $R^1$ has the scope of meaning of $R^1$, have now been found.

DETAILED DESCRIPTION OF THE INVENTION

Preferably, $R^6$ represents H, and $R^5$ and $R^6$ particularly preferably represent H. Also preferably, $R^7$ represents H. Furthermore preferably, $R^5$, $R^6$ and $R^7$ represent H, so that (I) represents unsubstituted iminodisuccinic acid and its salts (both, the acid and the salts, commonly designated as IDA) of the type described above.

Furthermore preferably, $R^1$, $R^2$, $R^3$ and $R^4$ are replaced by the radicals $R^{11}$, $R^{12}$, $R^{13}$ and $R^{14}$, with the meaning of H, Na, K, $NH_4$ or $H_3NCH_2CH_2OH$.

The compositions which are employed according to the invention as bleaching stabilizers and comprise substances of the formula (I) are present in a pure form or are accompanied by small amounts of secondary components from the preparation of (I), such as maleic acid, fumaric acid, aspartic acid, malic acid, asparagine, tartaric acid, hydroxyaspartic acid, condensates of aspartic acid and the like, or salts thereof with the abovementioned cations $R^1$ to $R^4$. The secondary components are present in the mixture in an amount of not more than 35% by weight, preferably 30% by weight, and particularly preferably 25% by weight; the remainder to 100% by weight is (I).

The preparation of (I) is carried out by known processes in an aqueous medium, for example from maleic anhydride, maleic acid or epoxy succinic acid and ammonia or aspartic acid. Processes of this type are described in GB 1 306 331, SU 0 639 863, JP 6/329 607, JP 6/330 020 and DE 3 739 610.

To render the bleaching regulators according to the invention alkaline, an alkali metal hydroxide or $NH_3$ can be added until a pH of 7.5 to 14 is reached. Such a wide pH range up to a strongly alkaline adjustment is possible in principle because alkali must in any case be added to the bleaching liquor to which the compositions according to the invention are added. However, merely for increasing the storage stability of the bleaching regulators according to the invention, a lower pH has proved to be more favorable. The pH is therefore preferably adjusted to 7.5 to 13.5, particularly preferably 7.5 to 12. Sodium hydroxide is the preferred alkali metal hydroxide, for reasons of cost, although KOH or LiOH are in principle also possible; it can be employed both in solid form and in the easily handled aqueous solution of, for example, 10 to 60% by weight.

The invention furthermore relates to the use of the above compositions comprising iminodisuccinic acid and the salts of the formula (I) as bleaching regulators, and therefore also to a process for the pretreatment of textile-forming natural plant or animal fibers or their mixtures with synthetic fibers or of yarns, woven fabrics, knitted fabrics or nonwovens of such fibers or their mixtures by bleaching in bleaching liquors which comprise water, alkali, hydrogen peroxide, wetting, washing and emulsifying agents and bleaching regulators, which comprises employing compositions of the type described above as bleaching regulators.

The pretreatment process can be carried out in a number of different embodiments, all of which are familiar as prior art to the expert: pretreatment in a long liquor (discontinuous or continuous process); cold pad-batch process (CPB); pad steam process; pad roll process and others.

Textile-forming natural plant fibers, for example those of cellulose, such as cotton, jute, linen or regenerated cellulose, and animal fibers, such as silk and wool, and mixtures thereof with synthetics can be bleached according to the invention. Plant fibers may be mentioned as preferred, particularly preferably cotton and mixtures thereof. Synthetic constituents of the mixture which may be mentioned are synthetic polyamide, such as nylon or perlon, polyester and polyacrylonitrile.

In the bleaching liquors to be used according to the invention, in addition to water, alkali metal hydroxide, wetting, washing and emulsifying agents and compositions according to the invention, as bleaching regulators, hydrogen peroxide is employed in an amount of 0.1 to 30 g/l. The alkali metal hydroxide is added and topped up in an amount such that the pH mentioned, of 7 to 14, is maintained in the bleaching liquor. Wetting, washing and emulsifying agents are those which are known to the expert operating in this field. These are individual substances or mixtures of the known anionic, cationic or nonionic surfactants; they are preferably anionic or nonionic surfactants, such as fatty acids and salts thereof, fatty acid alkyl esters, fatty alcohols, glycerides, alkylaromatic sulfonic acids, polyglycol ethers thereof and the like. These surfactants are chosen and made up in a manner known to the expert, such that the undesirable concomitant substances of the natural plant and animal fibers, such as fats, waxes and other plant constituents (for example residues of seed capsules and the like) and animal non-fibrous constituents are removed. The water employed can be completely desalinated water or water for industrial use which has been treated in the customary manner and has a varying degree of hardness, depending on its origin.

For bleaching, a composition comprising (I) or a mixture of several substances of the formula (I) is present as a bleaching regulator in the bleaching liquor in an amount of 0.1 to 30 g/l, preferably 0.1 to 20 g/l, particularly preferably 0.2 to 10 g/l. The compositions serve as stabilizers for the hydrogen peroxide. The release of oxygen for bleaching the fibers is regulated here. The compositions comprising substances of the formula (I) serve to complex and "mask" alkaline earth metals, in particular the troublesome Ca ions, and heavy metals.

The complexing action of substances of the formula (I) is in principle sufficient. However, in many cases it is favorable, and therefore an advantageous variant of the compositions according to the invention, additionally to employ other biologically degradable complexing agents, such as, for example, polyaspartic acid, citric acid and/or gluconic acid. Citric acid and gluconic acid can be employed both as a free acid and as an alkali metal salt (preferably as the sodium salt) in amounts of 0.1 to 30 g/l.

Mg ions and Ca ions, as an example of alkaline earth metal ions, and Fe, as an example of heavy metal ions, which are to be complexed, are natural constituents of the water for industrial use which is usually available. Alkaline earth metal ions and heavy metal ions can furthermore be introduced as impurities of the natural plant fibers to be bleached. If completely desalinated water is employed, both the Ca to be complexed and the Mg desired as a co-stabilizer are absent, while the constituents entrained by impurities in the natural plant fibers must still be taken into account. Mg ions can therefore be added to the bleaching regulators in amounts of 0.1 to 1 g/l, in addition to citric acid and/or gluconic acid. These dependencies taking into account the water available and the quality of the fiber to be bleached are known to the expert.

In order to obtain textile-forming substrates which can be dyed without problems, it is usually necessary also to carry out other treatment stages beforehand or afterwards, beyond the bleaching:

Singeing, burning off of the protruding fiber ends in order to achieve a smooth surface. This is usually the first working operation.

Boiling off, scouring, i.e. hot alkali treatment with the aim of pre-extraction of the fiber concomitant substances or swelling of the fibers and the seed coats of the cotton. This is usually carried out before the bleaching.

Causticization, mercerization, treatment with highly concentrated alkali, more or less under tension of the material, to achieve marked fiber swelling and therefore shine and elimination of the unripe or dead portions of cotton, which cannot be dyed or are poorly dyed. This can be carried out before or after the bleaching.

Acid extraction is carried out before the bleaching if extremely high amounts of heavy metals are present (from the water for industrial use and/or the fiber substrate). Excessive demands would otherwise be made on the complexing by the bleaching regulator.

Other bleaching processes are furthermore also used before or after the hydrogen peroxide bleaching to achieve very high degrees of whiteness, for example (a) sodium hydrochlorite bleaching
(b) sodium chlorite bleaching,
(c) reductive bleaching and/or
(d) enzymatic bleaching, in each case with and without addition of whiteners.

The compositions according to the invention can also be employed in all the treatment stages mentioned.

EXAMPLES

Example 1

Typical bleaching liquors were prepared with water of 0–20° C. german hardness as follows:

| | | Long liquor A) | CPB bleaching B) | PAD-steam C) |
|---|---|---|---|---|
| Magnesium sulfate | g/l | 0.2 | 0.2 | 0.3 |
| Bleaching regulator IDA | g/l | 1.0 | 4.0 | 4.0 |
| Sodium hydroxide solution (32% strength by weight) | ml/l | 6.0 | 30.0 | 20.0 |
| Hydrogen peroxide (35% strength by weight) | ml/l | 10.0 | 60.0 | 40.0 |

A) The untreated material (textile-forming substrate) was bleached at a liquor ratio of 1:10 at the boiling point for 45 minutes, rinsed and dried.

B) CPB=cold pad-batch process; the material was charged with the bleaching liquor (90–100% liquor pick-up), batched at room temperature for 24 hours, washed out and dried.

C) The desized material was charged with bleaching liquor (90–100% liquor pick-up), batched with saturated steam (100° C.) for 10 minutes, washed and dried.

After the treatment, the materials are tested and the brightening is measured:

| | Process | | |
|---|---|---|---|
| | A) | B) | C) |
| Whiteness reflectance 460 nm (%) after bleaching | 81 | 70 | 70 |

The same material was bleached with bleaching liquors comprising no regulator under the abovementioned conditions and the following results were found, in comparison with the abovementioned values:

| | Process | | |
|---|---|---|---|
| | A) | B) | C) |
| Whiteness reflectance 460 nm (%) after bleaching | 61 | 44 | 56 |

Example 2

Instead of the mixture from Example 1, the following mixture was employed:

76% by weight of IDA

5% by weight of magnesium chloride hexahydrate

19% by weight of gluconic acid/Na gluconate (50% strength)

The composition has a pH of 6.7.

The materials were tested after the treatment and the brightening was measured.

| | Process | | |
|---|---|---|---|
| | A | B | C |
| Whiteness reflectance 460 nm (%) after bleaching | 80 | 66 | 68 |

Example 3

A bleaching regulator according to the invention from Example 2, with citric acid monohydrate instead of with gluconic acid/Na gluconate, was employed.

The materials were tested after the treatment and the brightening was measured.

| | Process | | |
|---|---|---|---|
| | A | B | C |
| Whiteness reflectance 460 nm (%) after bleaching | 78 | 69 | 66 |

Example 4

The activity of the regulator according to the invention was demonstrated in boiling tests with a typical bleaching recipe using a reflux condenser, the bleaching liquor of completely desalinated water being loaded with iron salt (Fe+++ sulfate 1: 1000). For carrying out the tests, 200 ml of a bleaching liquor of the following composition was boiled in a reflux condenser for 30 minutes and the content of hydrogen peroxide were determined after 30 minutes (test b with the regulator according to the invention, test a without a regulator).

| | | Test | |
|---|---|---|---|
| | | a) | b) |
| Sodium hydroxide solution (32% strength by weight) | g/l | 6.0 | 6.0 |
| Regulator IDA | g/l | 0 | 4.0 |
| Hydrogen peroxide (35% strength by weight) | ml/l | 10.0 | 10.0 |
| Fe+++sulfate solution (1:1000) | g/l | 20.0 | 20.0 |
| $H_2O_2$ content | | | |
| at the start | ml/l | 10.4 | 10.2 |
| after 15 minutes | ml/l | 0 | 5.7 |
| after 30 minutes | ml/l | 0 | 2.4 |

What is claimed is:

1. A process for the pretreatment of crude cotton, jute, regenerated cellulose, silk or wool fibers, or mixtures of said fibers with synthetic fibers or of yarns, woven fabrics, knitted fabrics or nonwovens containing said crude fibers or mixtures by bleaching using a bleach and a bleaching regulator composition wherein said bleaching regulator composition comprises an iminodisuccinic acid, one of its salts or mixtures thereof with one another, of the formula (I)

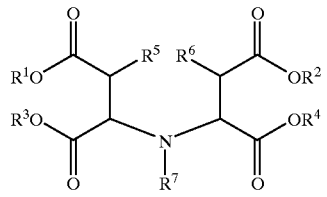

in which $R^1$, $R^2$, $R^3$ and $R^4$ independently of one another denote H, Li, Na, K, $NH_4$, $H_3NCH_2CH_2OH$, $H_2N(CH_2CH_2OH)_2$ or $HN(CH_2CH_2OH)_3$, $R^5$ and $R^6$ both represent hydrogen $R^7$ represents H, $CH_2CH_2OH$, $CH_2CH_2CH_2OH$, $CH_2CH(OH)CH_3$, $CH_2COOR^8$ or $CH_2CH_2COOR^8$, wherein $R^8$ independently of $R^1$ has the same meaning as $R^1$.

2. The process of claim 1, wherein $R^7$ represents H.

3. The process of claim 2, wherein $R^5$, $R^6$ and $R^7$ represent H.

4. The process of claim 1, wherein $R^1$, $R^2$, $R^3$ and $R^4$ represent H, Na, K, $NH_4$ or $H_3NCH_2CH_2OH$.

5. The process of claim 1, wherein the iminodisuccinic acid, its salts or mixtures thereof, is accompanied by maleic acid, fumaric acid, aspartic acid, malic acid, asparagine, tartaric acid, hydroxyaspartic acid, condensates of aspartic acid or salts thereof, the amount of accompanying substances being not more than 35% by weight of the bleaching regulator composition and the remainder to 100% by weight being (I).

6. The process of claim 5, wherein the amount of accompanying substances is not more than 30% by weight.

7. The process of claim 5, wherein the amount of accompanying substances is not more than 25% by weight.

8. A process for the pretreatment of crude cotton, jute, regenerated cellulose, silk or wool fibers, or mixtures of said fibers or of yarns, woven fabrics, knitted fabrics or nonwovens containing said fibers or mixtures by bleaching in a bleaching liquor which comprises water, alkali, hydrogen peroxide, wetting, washing and emulsifying agents and a bleching regulator which comprises an iminodisuccinic acid, one of its salts or mixtures thereof with one another, of the formula

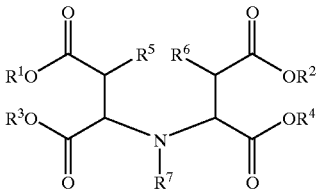

(I)

in which $R^1$, $R^2$, $R^3$ and $R^4$ independently of one another denote H, Li, Na, K, $NH_4$, $H_3NCH_2CH_2OH$, $H_2N(CH_2CH_2OH)_2$ or $HN(CH_2CH_2OH)_3$, $R^5$ and $R^6$ both represent hydrogen $R^7$ represents H, $CH_2CH_2OH$, $CH_2CH_2CH_2OH$, $CH_2CH(OH)CH_3$, $CH_2COOR^8$ or $CH_2CH_2COOR^8$, wherein $R^8$ independently of $R^1$ has the same meaning as $R^1$.

9. The process as claimed in claim 8, wherein said fibers are those of cotton, regenerated cellulose, wool, silk, or their mixtures with synthetic fibers.

10. The process of claim 9, wherein said fibers are those of cotton or its mixtures with synthetic fibers.

11. The process of claim 8, wherein the bleaching regulator is present in the bleaching liquor in an amount of 0.1 to 30 g/l.

12. The process of claim 11, wherein the bleaching regulator is present in the bleaching liquor in an amount of 0.1 to 20 g/l.

13. The process of claim 12, wherein the bleaching regulator is present in the bleaching liquor in an amount of 0.2 to 10 g/l.

14. The process of claim 8, wherein one or more compounds selected from the group consisting of citric acid, gluconic acid, polyaspartic acid, alkali metal salts thereof and magnesium salts thereof are present in the bleaching liquor.

* * * * *

UNITED STATES PATENT AND TRADEMARK OFFICE.

CERTIFICATE OF CORRECTION

PATENT NO : 6,056,787

DATED : May 2, 2000

INVENTOR(S) : Gerd Friedrich RENNER, et al.

It is certified that error appears in the above-identified patent and that said Letters Patent are hereby corrected as shown below:

Column 7, line 24, cancel "bleching" and substitute --bleaching--

Signed and Sealed this

Seventeenth Day of April, 2001

*Attest:*

Nicholas P. Godici

NICHOLAS P. GODICI

*Attesting Officer*

*Acting Director of the United States Patent and Trademark Office*